US006481591B2

(12) United States Patent
Mendoza et al.

(10) Patent No.: US 6,481,591 B2
(45) Date of Patent: Nov. 19, 2002

(54) LAUNDRY ROLL HAMPER

(76) Inventors: Rey Zabat Mendoza, 5515 Buggy Whip Dr., Centreville, VA (US) 20120; Wilhelmina Navarro Mendoza, 5515 Buggy Whip Dr., Centreville, VA (US) 20120

( * ) Notice: Subject to any disclaimer, the term of this patent is extended or adjusted under 35 U.S.C. 154(b) by 4 days.

(21) Appl. No.: 09/769,326

(22) Filed: Jan. 26, 2001

(65) Prior Publication Data

US 2002/0144997 A1 Oct. 10, 2002

(51) Int. Cl.[7] ..... A45C 13/04; B65D 30/10
(52) U.S. Cl. ..... 220/9.2
(58) Field of Search ..... 220/9.2, 9.3, 9.4

(56) References Cited

U.S. PATENT DOCUMENTS 1,848,929 A * 3/1932 Berg ..... 220/9.2
1,928,976 A * 10/1933 Grasso ..... 220/9.2
2,476,531 A * 7/1949 Berg ..... 220/9.2
2,655,970 A * 10/1953 Terry ..... 220/9.2
2,913,029 A * 11/1959 Paton ..... 220/9.2
4,040,460 A * 8/1977 Thornton ..... 220/9.2
4,299,365 A * 11/1981 Battle ..... 220/9.2
5,664,886 A * 9/1997 Hutchinson ..... 220/9.2
6,089,394 A * 7/2000 Ziglar ..... 220/9.2
6,102,569 A * 8/2000 Wang ..... 220/9.2
6,112,930 A * 9/2000 McAtarian ..... 220/9.2

* cited by examiner

*Primary Examiner*—Joseph M. Moy

(57) ABSTRACT

A cylindrical hamper bag or covering snugly fit over an internal frame that includes a circular top, a circular base, and at least six vertically upstanding leg members. The six leg members are of equal height and include hinges at the points connecting the leg members to the top and the base, and at points a third and two thirds of the length of each leg member permitting pivotal movement. The pivotal movement of the leg members allow the hamper to expand outwards and change shape from a cylindrical to a polygon shape ball.

1 Claim, 2 Drawing Sheets

LAUNDRY ROLL HAMPER

CROSS-REFERENCE TO RELATED APPLICATIONS

U.S. Pat. No. D412,229 Laundry Hamper

U.S. Pat. No. D413,099 Hamper

U.S. Pat. No. 5,881,975 Hamper

U.S. Pat. No. 4,646,802 Removable-supported hamper bag and foldable support thereof

STATEMENT REGARDING FEDERALLY SPONSORED RESEARCH OR DEVELOPMENT—Not Applicable

REFERENCE TO A MICROFICHE APPENDIX—Not Applicable

BACKGROUND OF THE INVENTION

This invention relates to a hamper for storing and transporting clothes, specifically to such laundry hampers, bags, and baskets which are used for carrying or transporting soiled clothes from one location (e.g., upstairs bathroom) to another location in the house (e.g., the laundry room in the basement) or other laundry establishment. More particularly, this invention relates to an improved laundry hamper with features which allows the hamper assembly to expand and resemble a polygon-shaped ball.

Hampers in general, and laundry hampers in particular, are available in a great variety of types and designs. One type of hamper comprises a container, often constructed of wicker or plastic that forms a storage chamber for soiled clothing. Such hampers ordinarily have a top closure or cover that is attached to the container and serves to shut the container when it is not in use. This type of hamper is either too heavy or bulky to carry. Soiled clothing that have accumulated within the hamper must periodically be transferred to a basket or other transport means, which is then carried to the washing machine which is in another location of the house. An example of a clothes hamper of this type is illustrated in U.S. Pat. No. D412,229. A similar type hamper includes a handle and wheels to facilitate transport to the laundry room. However, this type still needs to be held or carried down the stairs. An example of a hamper of this type is illustrated in U.S. Pat. No. D413,099.

Another type of hamper consists of a fabric bag that is supported upon an external frame or stand. The external frame may consist of a base and four or more leg members of equal height to support a fabric bag such as shown in U.S. Pat. No. 5,881,975. Other hampers employ support rods that extend vertically from the corners of a rectangular base. A fabric bag is held in an open, upright position by folding the bag over the ends of the support rods. Other hampers employ a support frame arranged as a pair of scissors-type linkages with cross arms at the frame top to support a fabric laundry bag in an upright and open attitude. An example of such hamper arrangements is shown in U.S. Pat. Nos. 4,646,802 and 5,507,577. The problem with these types of hampers is that they also have to be carried when full to the laundry room, and are either too bulky or heavy for most people.

SUMMARY OF THE INVENTION

It is an object of the present invention to provide a lightweight and expandable hamper assembly that can be reshaped from a cylindrical to a polygon shape in order to solve a previously unrecognized problem of having to carry the full hamper or having to transfer the soiled clothing to a laundry basket or bag for transporting to the laundry room in another part of the house.

Reference Numerals in Drawings

Figure 1:
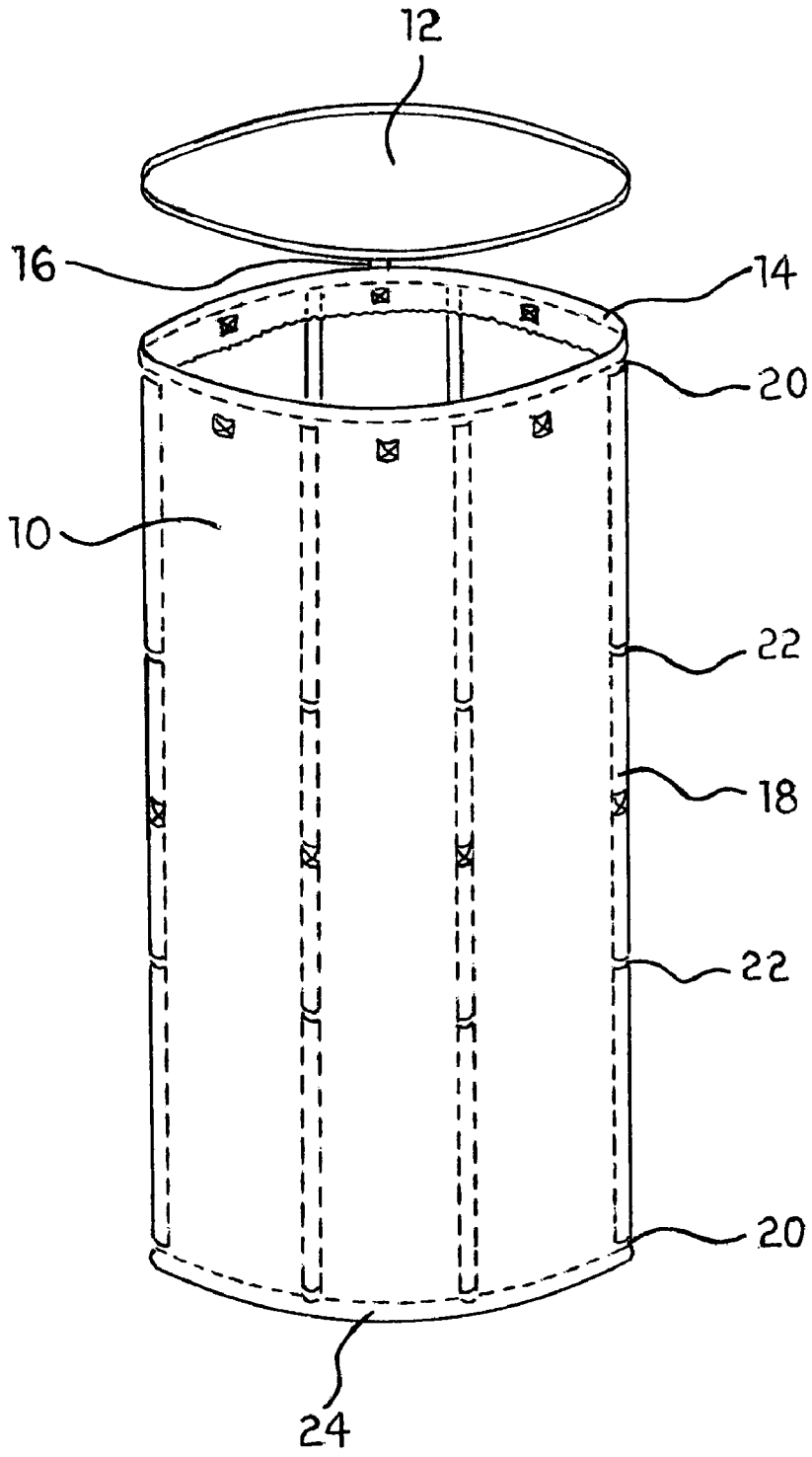
FIG. 1 Shows a perspective view of the laundry roll hamper in the upright position.

10 bag or covering
12 top cover
14 circular top frame
16 cover hinge
18 vertical leg members
20 frame hinges
22 leg hinges
24 circular base frame

DETAILED DESCRIPTION OF THE INVENTION

In one preferred embodiment, a hamper bag or covering is supported on an upright position by an internal frame having a top, a base, and at least six vertically upstanding leg members. In this embodiment, the leg members are joined to the top and the base at equal distances and parallel to one to the other at right angles. The leg members are joined to the top and the base by hinges. Each leg member also contains hinges at points one third and two thirds of the length of each leg. The hamper bag or covering encloses the entire frame and is folded over the top of the circular top frame to create an opening and is held in place by a securing means such as Velcro. A top cover is hinged to the top frame and is secured shut by Velcro. The hamper expands outwards in the middle section and changes its shape from a cylindrical to a polygon-shaped ball, which can then be rolled.

Laundry hampers are commonly used and placed in bathrooms in the upper floors of the house where most bedrooms are located. When it comes time to doing the laundry, the hampers are either carried or the soiled clothes are transferred from the laundry hampers to laundry baskets, which are hand-carried down the stairs, across the living room, dining room, kitchen, or family room to the laundry room located on the first floor or down the basement. Carrying the load and navigating from the upstairs bathroom, down the stairs, to the laundry room is both physically challenging and risky. Existing laundry bags, hampers, and baskets do not address or resolve this issue.

It is the object of the present invention to:

(a) Provide a laundry hamper which does not have to be carried from the upstairs bathrooms, down the stairs, across various rooms to the laundry room on the first floor or down the basement;

(b) Provide a laundry hamper that does not have to be emptied and the clothes transferred to a laundry bag or basket for transporting to a laundry room;

(c) Provide a cylindrical laundry hamper that expands and changes shape to resemble a hexagon or polygon-shaped ball so that it can be rolled with minimal effort instead of carried;

Further objects and advantages are to provide a laundry hamper that is lightweight, simple and economical to manufacture, allows airflow, and can be handled by persons of almost any age.

Figure 2:
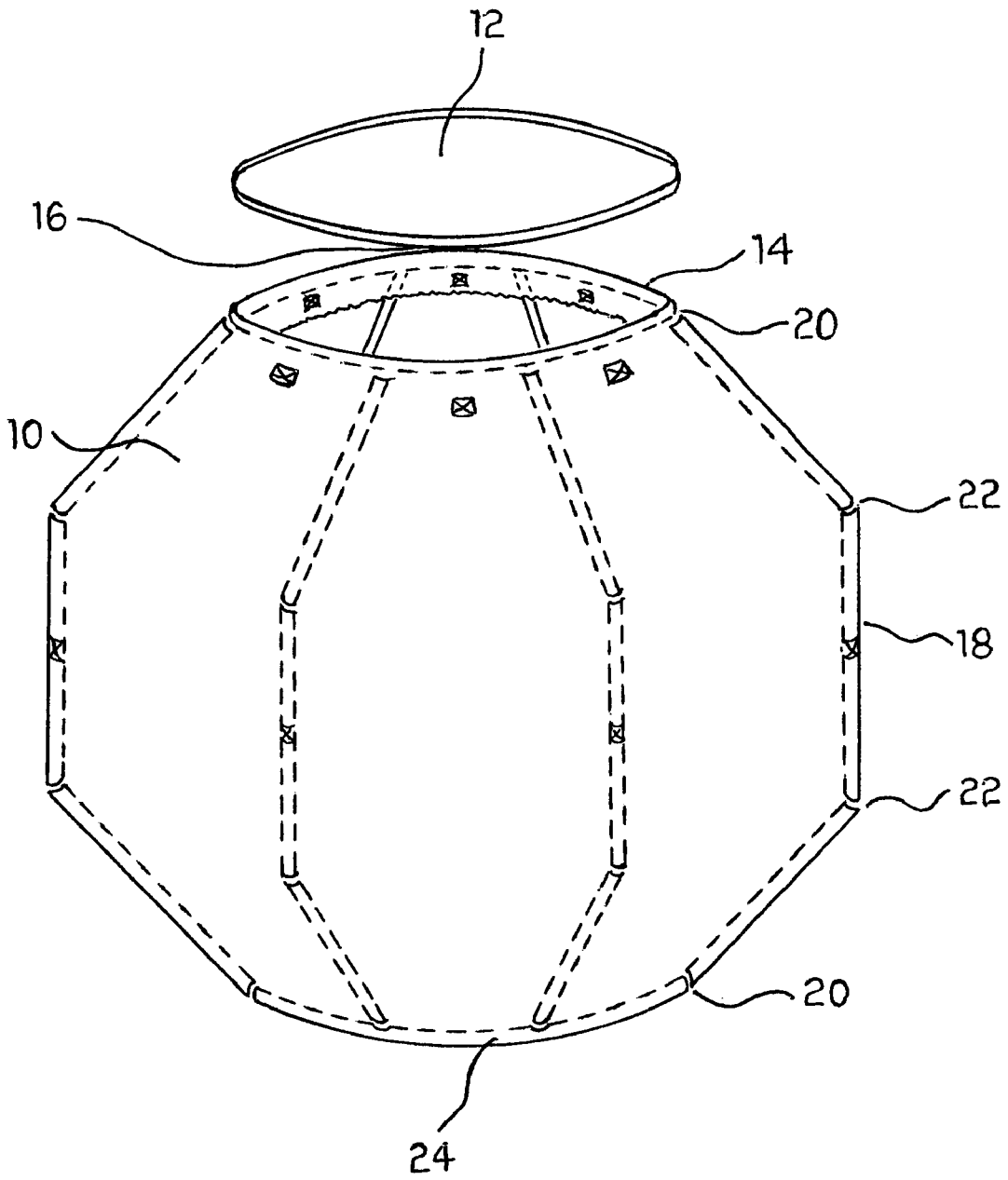
FIG. 2 Shows a perspective view of the laundry roll hamper in the expanded position.

A preferred embodiment of the laundry roll hamper is illustrated in FIG. 1 (upright position) and FIG. 2 (expanded position). The laundry roll hamper is composed of a fabric or woven nylon bag or covering 10 and an internal frame made of plastic or other flexible, lightweight material. Bag or covering 10 encloses the entire frame and folds over a circular top frame 14 creating an opening and is secured by Velcro. A top cover 12 of plastic or other lightweight material or fabric similar to bag or covering 10 serves as the top closure. Top cover 12 is attached to top frame 14 by a cover hinge 16 creating a flap for opening and closing. Velcro secures top cover 12 when the top is closed and secured. Top frame 14 is joined to six or more vertical leg members 18 by frame hinges 20, which allow leg members 18 to be repeatedly bent outwards and straightened without fracturing. Frame hinges 20 are of the type that only allow leg members 18 to bend outwards but not inwards when straightened. Each of leg members 18, in turn, have at least two leg hinges 22 that are equidistant to frame hinges 20 at the top, to each other, and to frame hinges 20 at the bottom. Leg hinges 22 are the pivot points that allow the top third and the bottom third of leg members 18 to bend outward at 45-degree angles while the middle third remains in a vertical orientation. Leg hinges 22 are of the type that causes leg members 18 to snap and lock in place at or close to the vertical (90-degree) and at the bent (45-degree) positions. Leg hinges 22 will not allow leg members 18 to bend inwards beyond the vertical when straightened. Bag or covering 10 secures the middle portion of leg members 18 by Velcro or other fastening means in order to maintain each of leg members 18 positions and distance to one another. The bottom of leg members 18 are joined to a circular base frame 24 by frame hinges 20. Base frame 24 is made of the same material as top frame 14 and leg members 18. Base frame 24 has the same diameter as top frame 14 and is wide enough to allow the entire structure to stand upright when the hamper is empty and remain stable when the hamper is full and expanded. Bag or covering 10 also encloses the base. The laundry roll hamper can be made of various sizes, colors, designs, and combinations of fabric and material to fit ones needs and desires.

The empty laundry roll hamper is upright as shown in FIG. 1. Soiled clothes are deposited by opening the top cover 12 and dropping the clothes through the opening at top frame 14. The hamper maintains its shape and position as it is filled with clothes. When the hamper is full, or even partially full, downward pressure is exerted on top frame 14, or outward pressure to leg hinges 22 at each of leg members 18, which then bend outwards at the pivot points at frame hinges 20 and leg hinges 22 causing the hamper to expand and resemble a hexagon or polygon-shaped ball, as shown in FIG. 2. Leg members 18 are locked in the bent position. Base frame 24 keeps the expanded hamper stable until it is ready to be moved. Top cover 12 is then secured to top frame 14 by Velcro to prevent the clothes from falling off when the hamper is finally rolled. Pushing with either the hands or the feet, whichever is preferred, allows the expanded laundry hamper to roll with minimal effort. The hexagon or polygon shape provides some degree of control over flat surfaces and, if need be, can be controlled down the stairs with the hand. Otherwise, the laundry roll hamper can simply be allowed to roll down the stairs. The lightweight material used for the frame and covering should not cause any damage to stair railings, walls, or floors that it may come in contact with as it rolls down. The entire frame of the laundry roll hamper remains flexible and pliant yet maintains its shape as it is rolled from the upstairs bathroom, through the passageway, down the stairs, through the living room, kitchen, or family room, to the laundry room on the first floor or further down the basement. In the laundry room, top cover 12 is then unfastened and opened to remove the clothes. After the clothes are removed, leg members 18 can then be straightened by pulling up on top frame 14 while holding down base frame 24 with the feet. Or, by manually applying simultaneous inward pressure to opposite leg hinges 22 to unlock and bring the laundry roll hamper back to the upright position where the leg members again lock in place.

Thus the reader will see that our invention of the laundry roll hamper provides a very unique, practical, lightweight, yet economical container that eliminates the risk, challenge, and the difficulty of transporting soiled clothes from the upstairs bathroom, down the stairs, to the laundry room on the first floor or down the basement. The laundry roll hamper can simply be expanded and rolled like a ball with minimal effort. Furthermore, the laundry roll hamper has the additional advantages in that:

- it permits persons of almost any age to handle and roll the hamper;
- it aids the elderly in living more independently;
- it allows children to be able to help with the laundry and have fun in the process;
- it gives people with back problems the comfort knowing that they will not have to lift and carry the hamper and aggravate their already delicate condition;
- it eliminates the need for laundry bags and baskets for transporting soiled clothes.

While the above description contains many specifications, these should not be construed as limitations of the scope of the invention, but rather as an exemplification of one preferred embodiment thereof. Many other variations are possible. For example, the bag or covering and top cover can be of various material, fabrics, color, designs, prints, etc.; the top cover can be secured by Velcro, zipper, or other means. The entire frame can be made of plastic or other lightweight, pliant material, or combination thereof, and vary in size and shape. The hamper itself can be made of various sizes to fit ones needs and desires.

Thus the scope of our invention should be determined by the appended claims and their legal equivalents, rather than by the examples given.

What we claim as our invention is:

1. A partially collapsible hamper having a cylindrical upright state and a polygon expanded state, comprising a top and a bottom circular frame, a plurality of pivoting vertical leg members extending between the top and bottom circular frames, a body of flexible sheet material extending from the top circular frame down to and enclosing the vertical legs and bottom circular frame, said vertical leg members are connected to the top and bottom circular frames by hinges, each vertical leg member divided into three equal parts and joined together by hinges at points a third and two thirds of the length of each leg member, the improvement comprising said hinges that lock said leg members in the vertical position until downward pressure is applied to unlock the hinges and move the top third and bottom third portions of said leg members outward and away from the center to 45-degree angles from the vertical where said hinges again lock in place while the middle third portion of said leg members remain in the upright vertical orientation.

* * * * *